US005462002A

United States Patent [19]

Wendt et al.

[11] Patent Number: 5,462,002

[45] Date of Patent: Oct. 31, 1995

[54] SHIP, ESPECIALLY A FERRY, WITH A BOW DOOR

[75] Inventors: Heinz Wendt; Bruno Pataj, both of Bremen, Germany

[73] Assignee: Macor Marine Systems International GmbH, Bremen, Germany

[21] Appl. No.: 196,138

[22] PCT Filed: May 7, 1993

[86] PCT No.: PCT/EP93/01119

§ 371 Date: Apr. 11, 1994

§ 102(e) Date: Apr. 11, 1994

[87] PCT Pub. No.: WO94/00331

PCT Pub. Date: Jan. 6, 1994

[30] Foreign Application Priority Data

Jun. 24, 1992 [DE] Germany ..... 42 20 435.6

[51] Int. Cl.[6] ..... B63B 35/40

[52] U.S. Cl. ..... 114/260

[58] Field of Search ..... 114/26, 65 R, 114/258, 259, 260, 201 R

[56] References Cited

U.S. PATENT DOCUMENTS

| | | | |
|---|---|---|---|
| 3,280,777 | 10/1966 | Matzer | 114/260 |
| 4,135,468 | 1/1979 | Kirby et al. | 114/260 |

FOREIGN PATENT DOCUMENTS

| | | |
|---|---|---|
| 1170873 | 1/1959 | France . |
| 2312447 | 12/1976 | France . |
| 1085752 | 10/1967 | United Kingdom . |

*Primary Examiner*—Stephen Avila

*Attorney, Agent, or Firm*—Merchant, Gould, Smith, Edell, Welter & Schmidt

[57] ABSTRACT

The bow door (9) of a ferry consists of two sections (7) of the sides (5) on either side of the stem beneath the foredeck (4) and a section (10) of the foredeck lying thereabove. These side and foredeck sections (including the relevant section of the stem) are joined together to form an integral insert in the ship's hull (9). This insert can be pivoted from the closed position into an open position substantially above the foredeck (4) to provide a bow opening through said foredeck.

6 Claims, 4 Drawing Sheets

9
10
7
13
12
6
3
18
18
15
13
4
10
C
4
14
17
12
19
30
C
11
12a
C
8
16
C
9
20
B
5
B
2
7
A
A
1

SHIP, ESPECIALLY A FERRY, WITH A BOW DOOR

BACKGROUND OF THE INVENTION

The invention relates to a ship, especially a ferry, having a bow door, which is formed by a part of the ship's hull in the bow region, which part can be upwardly tilted around a horizontally extending axis. The bow door is used to open the ship in the region of its stem, so that, in the so-called ro-ro traffic, vehicles which have driven onto the stern can leave the ship's hull in the longitudinal direction and without changing direction; naturally the entry and exit directions can be reversed.

The formation of the bow door from the entire ship's bow above the water line is known: the bow part separated from the remainder of the ship's hull by a more or less vertical section is swivelled upwardly (and forwards) around an axis, which extends parallel to the joint passing transversally from one side wall to the other. A ramp, for example, can be swivelled out through the bow opening formed in this manner so as to come to rest on a quay wall or similar.

It is clear that, in a relatively large (ferry) ship, the upward swivelling of the entire bow portion lying above the water line means that considerable weights have to be moved. This in turn requires correspondingly strong and expensive movement mechanisms and control systems. In addition, the upwardly tilted bow portion obstructs the view of the attendance crew over the entire ship's width during the approach to the berth i.e. when entering a ferry berth; on the other hand its relatively early opening is necessary, not least because of the bow door which also swivels out to the front. Therefore bow openings which consisted of two door wings, which—in the closed position forming the stem along their common edge—were swung out laterally from the side walls of the ship's hull above the water line and beneath the foredeck over a certain lateral length, have already been produced. The division of the bow opening into two door halves which are independent of one another, one of which is pivoted towards the starboard and the other of which is pivoted towards the port, has the disadvantage, not associated with the bow door discussed above, of lower stability, which necessitates corresponding measures in the locking mechanism in the closed state and also in the opening mechanism. However the fact that to open these bow doors very much smaller masses of the ship's hull have to be moved than in the case of the bow door previously described is advantageous.

SUMMARY OF THE INVENTION

The object of the invention is to combine the advantages of one system with those of the other, whilst at the same time avoiding the disadvantages of both. The solution to this problem lies in that the bow door consists of two parts cut out of the side walls on either side of the stem beneath the foredeck and a portion of the foredeck lying thereabove, which are connected to one another and to the associated portion of the stem to form an integral insert in the ship's hull, which can be swivelled from a closed position through the cut-out section in the foredeck portion into an open position substantially above the foredeck.

The insert to be moved to open the bow door therefore, with respect to the bow opening, only consists of the side wall portions required to this extent (as in the laterally swivelling leaf door system) and also a foredeck portion, which exposes a section which is adequate for the swivelling passage of the two side wall parts. Because these three parts extending in very different planes are rigidly connected to one another, great stability is inherent to the insert which can be outwardly swivelled. And because at the same time a portion of the foredeck extending in a tight manner around the foredeck cut-out section can be connected to the side wall portions above the insert to form a ship's hull portion which protrudes around and over the insert at the front and laterally, the framework surrounding the insert (in several planes), which consists of side walls of the ship's hull and a foredeck, also possesses high rigidity, which is important both in the closed and also in the open state of the insert.

Furthermore the moved masses are reduced to a fraction in comparison with the bow door mentioned at the beginning, which taken by itself has roughly the same rigidity. Thus the surfaces affected by the wash are also reduced, so that the forces to be absorbed to this extent by the bow door are less. Besides these forces are to be transferred in a more favourable manner into the ship's hull on account of the all-round attachment of the insert.

The further advantage that, in comparison with the known bow door, a considerably smaller fraction of the foredeck in the bow region participates in the opening operation and correspondingly more deck area—right to the stem—is available for warping gears and similar, is important for the operation of the ship.

The insert is preferably sealed in its closed position with respect to the remainder of the ship's hull. In this case it is necessary on account of the prevailing (if not required) swivelling kinematics to reverse the sealing direction over roughly half the height of the side wall joints extending more or less parallel to the stem—i.e. in the place where their distance from the swivel axis of the insert is at its smallest. The measures required for this are known and cause no difficulties. Here—as in the refinement according to the invention altogether—the fact that the side walls of the ship's hull strongly protrude laterally in the bow region plays a role.

In the region of the side edges of the foredeck portion extending parallel to the longitudinal axis of the ship, the insert is advantageously attached to arms extending parallel thereto, which are pivoted on stanchions on the foredeck. Whereas the rearmost point of the insert (in the side walls of the ship's hull) expediently lies slightly beneath the swivel axis of the insert, the foredeck portion needs to extend astern only slightly above the previously mentioned sealing reversal point, so that the insert is attached to relatively long arms, the swivel axis of which lies only slightly above the foredeck in relation thereto, for which reason the insert only performs a forwards movement falling in weight in its lower region when it is upwardly swivelled.

However in particular it is the substantially smaller width and height of the insert which substantially improve the visibility from the bridge when entering a berth with the bow door open in comparison with the bow door mentioned at the beginning (consisting of a bow section passing over the entire width and greater height of the ship).

BRIEF DESCRIPTION OF THE DRAWINGS

Further details and advantages of the new bow door become apparent from the following description of an exemplified embodiment by means of the drawings. In a diagrammatical representation are shown.

DETAILED DESCRIPTION OF THE PREFERRED EMBODIMENT

Figure 1:
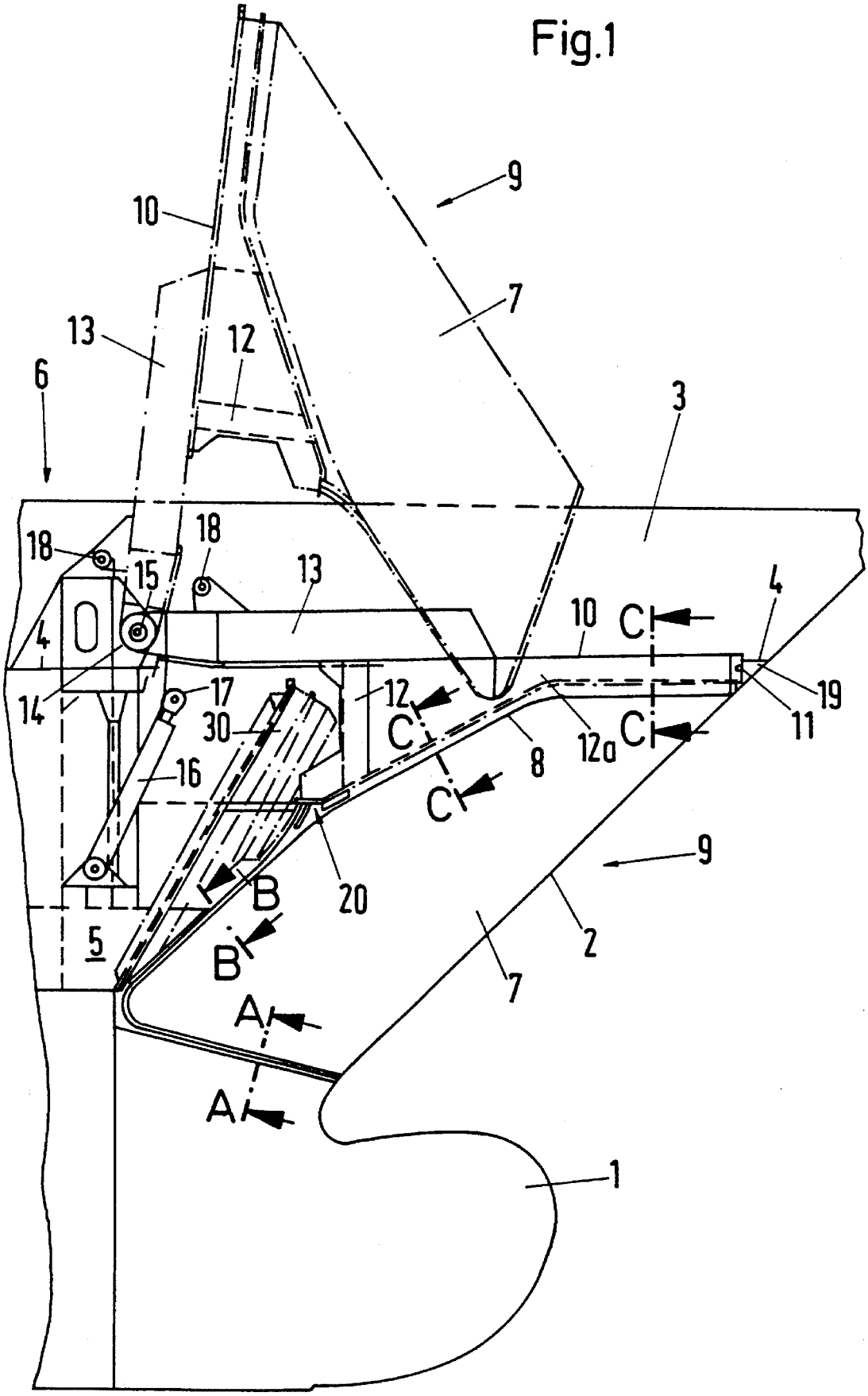
FIG. 1 the bow of a ship having the bow door according to the invention in longitudinal section.

The sectional view of the bow region of a ferry in FIG. 1 represents the inner port side. Above a bulbous bow 1 the stem 2, which is straight in the example, extends obliquely upwards, and in fact in the region of the bulwark 3 over the foredeck 4. The side walls 5 of the ship's hull designated overall by 6 extend astern from the stem 2, whereby the ship's hull 6 becomes wider and the side walls 5 outwardly project in the bow region.

Figure 2:
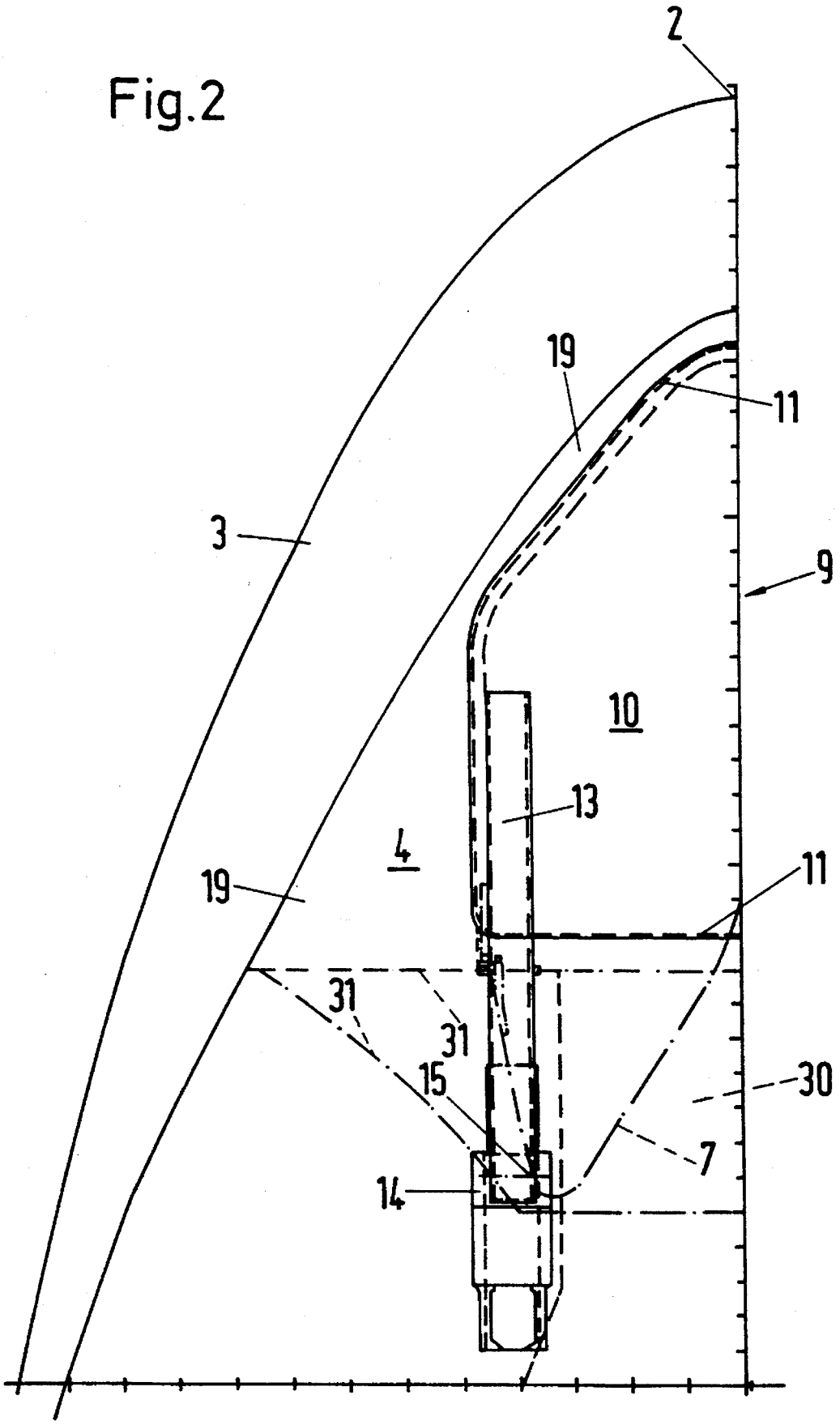
FIG. 2 a plan view of substantially the bow region of the ship represented in FIG. 1, but only as far as its longitudinal centre line.

Beneath the foredeck 4 on either side of the stem 2, parts 7 of the two side walls 5—converging at the stem 2—are cut out from said side walls, and in fact along a line 8, which first of all extends astern beneath the foredeck 4 and parallel thereto from the stem 2, then extends obliquely astern and downwardly substantially parallel to the stem and returns above the bulbous bow 1 to the stem 2. The two parts 7 cut out of the side walls 5 on the port and starboard side are—similarly to butterfly wings—joined to one another to form a bow door designated overall by 9. To the bow door 9 there also belongs a portion 10 of the foredeck 4, which closes and respectively exposes a section 11 in the foredeck 4 (FIG. 2). The portion 10 is securely connected to the parts 7 (inter alia by vertical struts 12) and with them forms an integral insert piece of the ship's hull, which can be swivelled out of the ship's hull in the manner described below and in this open position exposes a bow opening.

In FIG. 1 the bow door 9 formed by the insert described above is represented by unbroken lines in its closed position inserted into the ship's hull 6 and also by dot-dash lines in its open position when it is substantially moved out of the ship's hull 6, i.e. swivelled upwards. For the purpose of the outwardly swivelling movement, to the portion 10 of the foredeck 4 and thus the bow door 9 are attached arms 13, one on the port side and one on the starboard side, and each arm is pivoted at a stanchion 14 around a common swivel axis 15. Hydraulic cylinders 16 anchored beneath the stanchions 14 act on the arms 13 at 17. Eyes 18 are used to lock the arms 13 and thus the bow door 9 in the open position (shown by dot-dash lines).

The swivel movement, which can be seen from the final positions of the swivel movement of the bow door 9, during the opening and closing of the bow door clearly shows that the section 11 in the foredeck 4 and thus the portion 10 of the foredeck belonging to the bow door insert 9 may be shorter in the longitudinal direction of the ship than the parts 7 of the bow door 9 which extend astern. This results in a compact design of the bow door 9 and a further reduction in the masses to be moved when opening and closing the bow door.

Above the portions of the lines 8 extending parallel to the foredeck 4, a portion of the foredeck 4, which on the bow side extends around the portion 10 of the foredeck 4 belonging to the bow door 9, remains unaffected by the bow door 9 and its opening and closing movements. The same applies to the following side wall portions above those portions of the line 8, so that a bow-shaped ship's hull portion 19 connected to the remainder of the ship's hull 6 protrudes around and over the insert forming the bow door 9 at the front and laterally. According the bulwark 3 also remains unaffected by the bow door 9.

The parts 7 of the bow door 9 (belonging to the side walls of the ship 5) are sealed substantially along lines 8 with respect to the remaining ship's hull 6, in which case the sealing joints and seals inside the ship's hull are disposed substantially behind the joint following line 8 between the parts 7 and the associated side walls 5.

Figure 6:
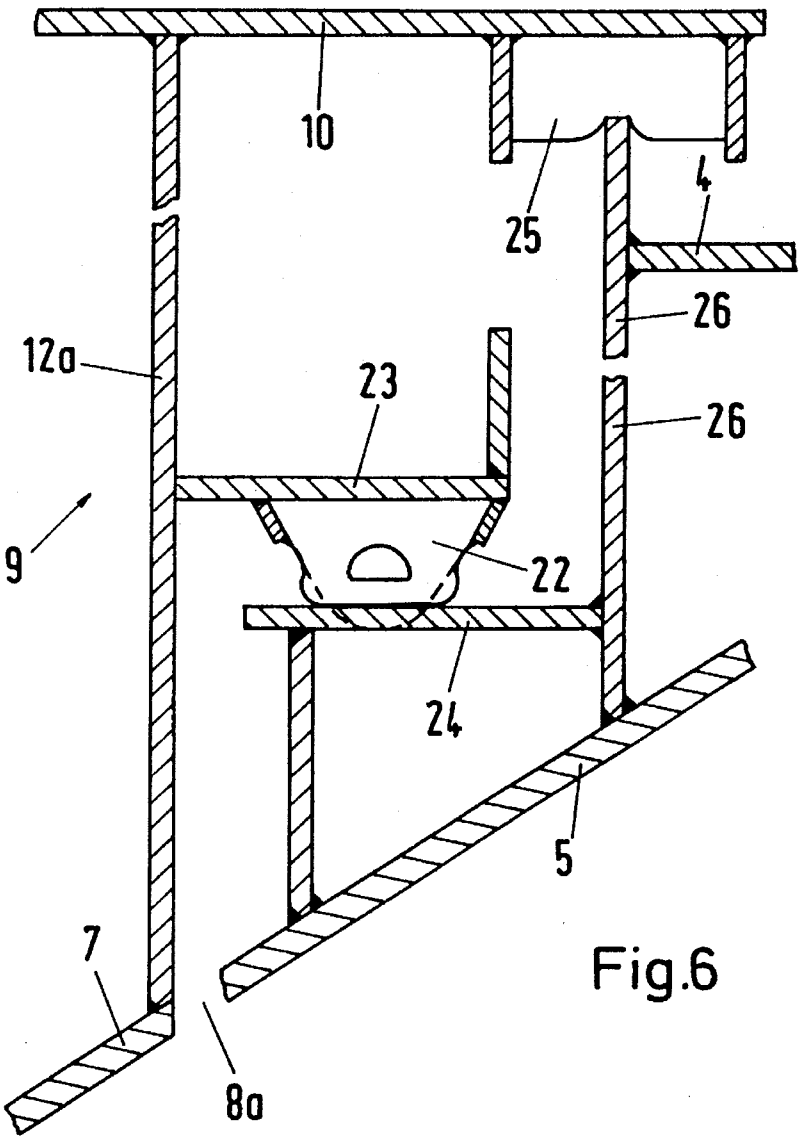
FIG. 6 further section along lines C—C in FIG. 1.
Figure 4:
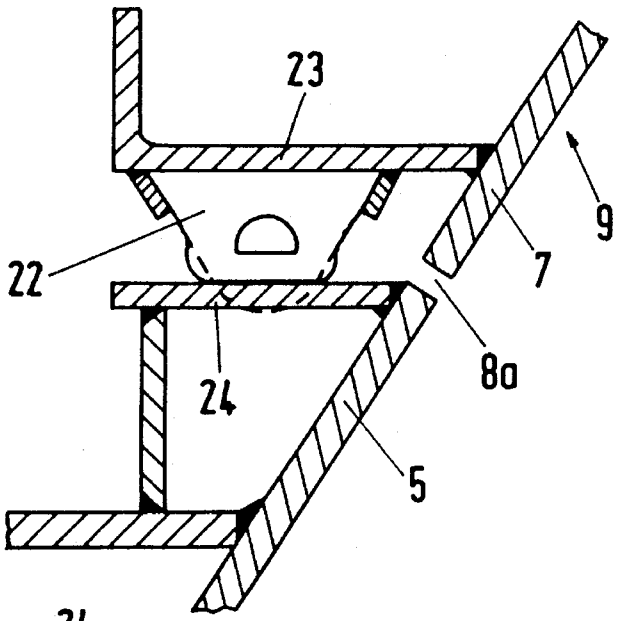
FIG. 4 a section through the bow door seal along line A—A in FIG. 1.
Figure 5:
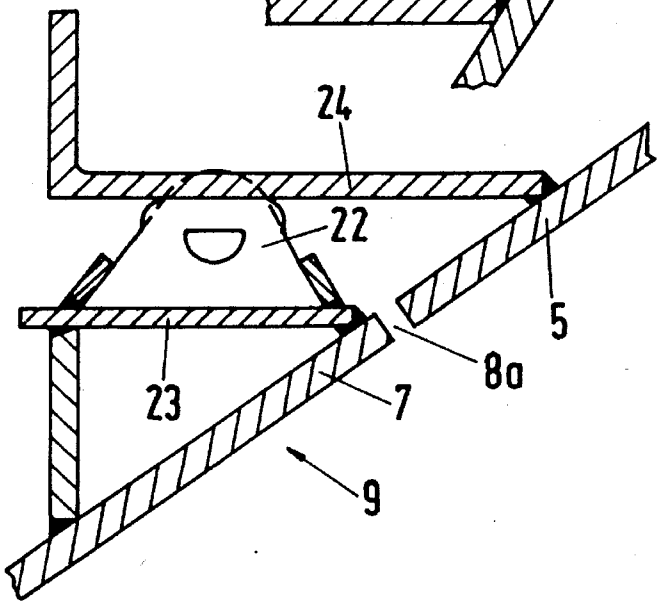
FIG. 5 a corresponding section along line B—B in FIG. 1.

FIGS. 4 to 6 shows a possible design of the sealing arrangement. In this case it should be noted that in the upper region of the bow door 9 during its opening the parts 7 immediately penetrate the ship's hull 6 (which is possible on account of the greatly projecting side walls 5 there), while in the lower region the parts 7 firstly move outwardly—i.e. away from the following portions of the side walls 5 surrounding them, before later on they are also swivelled through the upper region of the bow-side opening (line 8) of the side walls 5 exposed by the opened bow door and also the section 11 in the foredeck 4. Therefore it is necessary to perform a change in the sealing direction at 20; at 20 the line 8 has at its smallest distance from the swivel axis 15 of the arms 13 and thus of the bow door 9.

The sections A—A and B—B lying beneath the sealing direction reversal point 20 (FIGS. 4 and 5) show a (continuous) profiled joint 22 made from an elastic material, which is attached to a bracket 23, which in turn is welded to the inner faces of parts 7 of the bow door 9, and in fact adjacent to the joint 8*a* following line 8. In the closed state represented, the profiled joint 22 is pressed against an abutment 24, which is accordingly welded, parallel to the bracket 23, to the surrounding side wall 5.

As shown by the sections C—C (FIG. 6), a double seal is provided above the reversal point 20. Firstly at a wall 12*a* corresponding to the vertical struts 12, which wall is part of the bow door insert, a profiled joint 22, which is forced against an abutment 24, is in turn attached to a bracket 23. Secondly on the underside an elastic sealing strip 25, which in the closed state of the bow door 9 is forced against a coaming-like wall 26, which is welded vertically to the obliquely extending side walls 5 and rises above the surrounding foredeck 4, is retained on the portion 10, also belonging to the bow door 9, which is slightly upwardly displaced in the manner of a hatchway cover in relation to the remaining foredeck 4.

Figure 3:
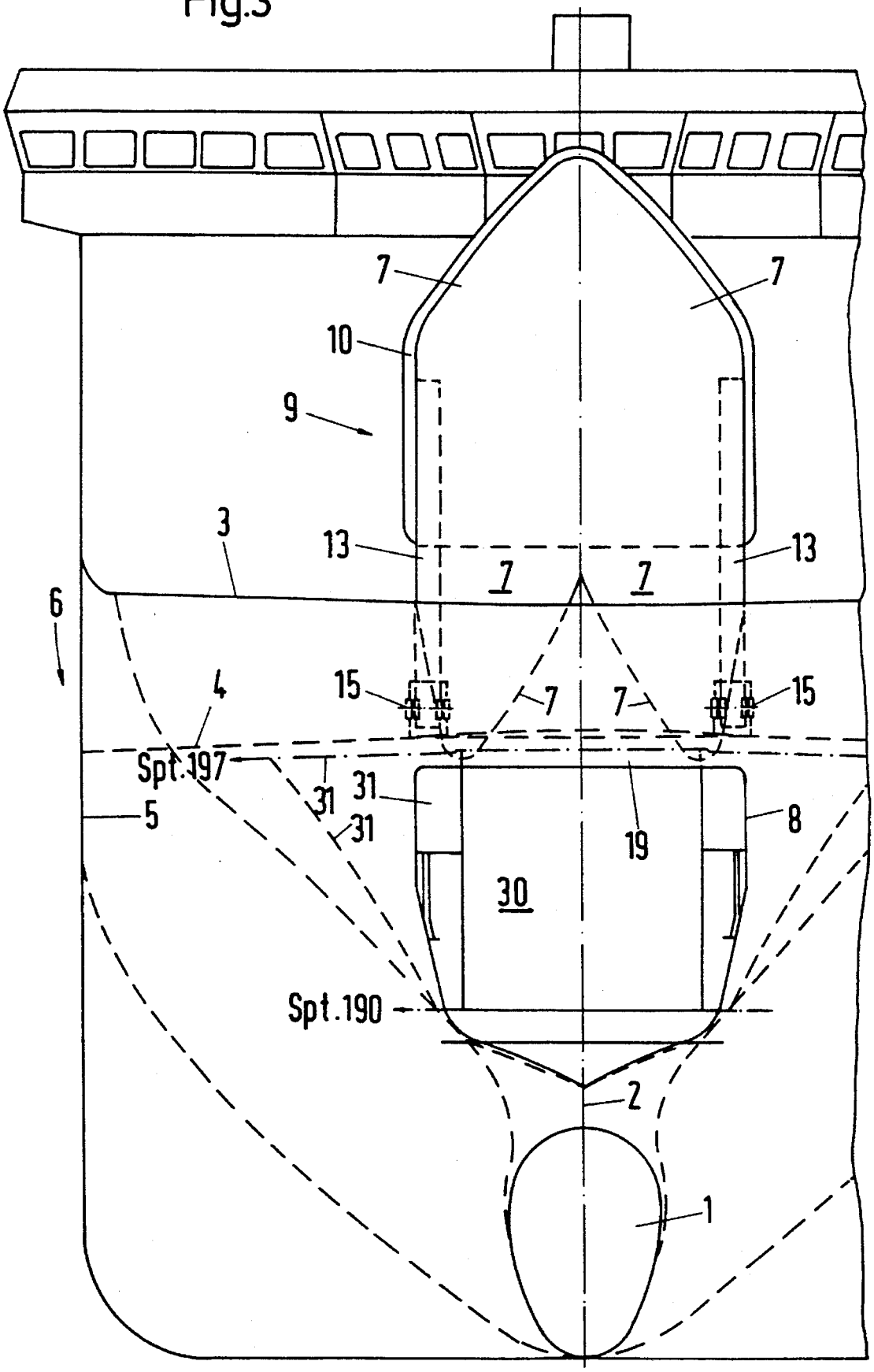
FIG. 3 a laterally divided view of the ship from the front with the bow door open.

For the sake of completeness it should also be pointed out that in the longitudinal direction of the ship behind the bow door 9 is located a ramp 30, which can be swung out and unfolded, and which in the retracted state with the inclined side walls 31 (which can be seen in FIGS. 2 and 3) forms a collision bulkhead, however when the bow door is opened it can be swivelled out and unfolded and also can be laid—across the bulbous bow 1—on a quay wall or similar.

We claim:

1. A ship, in particular a ferry, having a bow door, which includes a part of a ship's hull in a bow region, which can be upwardly tilted around a horizontally extending axis and encloses a portion of a stem of the ship, and comprises two parts of side walls of the ship's hull cut out on either side of the stem beneath a foredeck of the ship; and the bow door additionally comprising a first portion of the foredeck lying over the parts of the side walls, and the parts of the side walls and the first portion of the foredeck being joined to one another with associated portion of the stem to form an integral ship's hull insert, the ship's hull insert being swivelled out of a closed position through a section defined by the first portion of the foredeck into an open position substantially above the foredeck.

2. A ship according to claim 1, wherein a second portion of the foredeck, which on a bow side extends around the first portion of the foredeck in a tight manner, is connected to side wall portions above the ship's hull insert to form a ship's hull portion which protrudes around and over the ship's hull insert at a front and laterally.

3. A ship according to claim 1, wherein the ship's hull insert is sealed in the closed position with respect to a remaining of the ship's hull.

4. A ship according to claim 3, wherein in a region of side edges of the first portion of the foredeck extending parallel to a longitudinal axis of the ship, the ship's hull insert is attached to arms extending parallel thereto, which are pivoted to a stanchions on the foredeck.

5. A ship according to claim 4, wherein a hydraulic cylinder of the ship having pistons, the hydraulic cylinder attached beneath the stanchions acts with the pistons on the arms.

6. A ship according to claim 1, wherein the ship's hull insert swivels between the opening position and the closing position, opening of the ship's hull insert does not result in an extension of ship's overall length.

* * * * *